US006273042B1

(12) United States Patent
Perez et al.

(10) Patent No.: US 6,273,042 B1
(45) Date of Patent: Aug. 14, 2001

(54) ROCKER ASSEMBLIES FOR CONTROL OF ENGINE VALVES AND METHOD OF ASSEMBLING SUCH ROCKER ASSEMBLIES

(75) Inventors: Vincent M. Perez, South Elgin; David E. Rempfer, DeKalb, both of IL (US)

(73) Assignee: Amsted Industries Incorporated, Chicago, IL (US)

( * ) Notice: Subject to any disclaimer, the term of this patent is extended or adjusted under 35 U.S.C. 154(b) by 0 days.

(21) Appl. No.: 09/332,475

(22) Filed: Jun. 14, 1999

(51) Int. Cl.[7] ..... F01L 1/18

(52) U.S. Cl. ..... 123/90.39; 123/90.45; 123/90.47

(58) Field of Search ..... 123/90.39, 90.4, 123/90.41, 90.42, 90.43, 90.44, 90.45, 90.46, 90.47, 90.48, 90.52, 90.27, 502; 29/898.063

(56) References Cited

U.S. PATENT DOCUMENTS

| | | | | |
|---|---|---|---|---|
| 3,859,973 | * | 1/1975 | Dreisin | 123/502 |
| 4,164,062 | * | 8/1979 | Sullivan | 29/898.063 |
| 4,708,103 | * | 11/1987 | Speil | 123/90.46 |
| 4,724,805 | * | 2/1988 | Wirth et al. | 123/90.39 |
| 4,856,468 | * | 8/1989 | Speil et al. | 123/90.46 |
| 5,570,665 | * | 11/1996 | Regueiro | 123/90.27 |
| 5,632,237 | * | 5/1997 | Cornell et al. | 123/90.46 |
| 5,640,934 | * | 6/1997 | Mori | 123/90.52 |
| 5,645,023 | * | 7/1997 | Regueiro | 123/90.27 |
| 5,706,771 | * | 1/1998 | Van Heyningen et al. | 123/90.46 |

* cited by examiner

*Primary Examiner*—Thomas Denion
*Assistant Examiner*—Tu M. Nguyen
(74) *Attorney, Agent, or Firm*—Edward J. Brosius

(57) ABSTRACT

Improved rocker assemblies for use in opening a valve in an engine are disclosed, along with an improved method of assembling the rocker assemblies. The rocker assemblies have pivotable rocker arms with rocker balls and sockets as in the prior art. A retainer is used to secure the sockets on the rocker balls, as in the prior art. Novel retainers are disclosed that are made of either thermoset, thermoplastic or epoxy polymers. At least part of the retainer extends beyond the socket to a position between the top of the socket and the end of the rocker arm. The retainer may extend along the side of the socket to the socket bearing surface, and may have one or more channels to deliver lubricant to the bearing surfaces of the socket and the valve stem. The retainer may also have spacers that extend beyond the level of the socket bearing surface to define the desired valve lash distance between the socket bearing surface and the valve bearing surface. The socket may be shallower than prior sockets, and thus may be formed in less expensive ways, such as by cold heading a metal slug or by forming a powder metal compact in the desired shape instead of through machining. A method of assembling rocker components is also disclosed. In the method, the retainer is secured to the socket with at least part of the retainer outside of the socket. The rocker ball is then inserted into the socket through the retainer.

27 Claims, 7 Drawing Sheets

ROCKER ASSEMBLIES FOR CONTROL OF ENGINE VALVES AND METHOD OF ASSEMBLING SUCH ROCKER ASSEMBLIES

BACKGROUND OF THE INVENTION

1. Field of the Invention

The present invention relates to an improved rocker assembly for use in engines, and to methods of assembling such improved rocker assemblies.

2. Description of the Prior Art

In piston-powered engines for vehicles and tools such as lawnmowers, the engines have a camshaft and crankshaft working in concert. The pistons move up and down in cylinders, driving the crankshaft. The crankshaft is typically linked to the camshaft, so that the camshaft rotates as the crankshaft rotates. As the camshaft rotates, cylinder valves are opened and allowed to close. As one valve opens, air or a fuel-air mixture is allowed to enter the piston cylinder. As another valve opens, exhaust leaves the piston cylinder.

The camshaft has a plurality of spaced cams that rotate as the camshaft rotates. As the cams rotate, they push against push rods, to reciprocate the push rods. Each push rod has one end that bears against one end of a rocker assembly mounted on the engine. The rocker assemblies include rocker arms that are pivotally mounted on the engine. As each the rocker arm pivots, a second end pushes against a bearing surface on a valve stem to open the cylinder valve. A biasing spring returns the valve to the seated position and the rocker arm pivots back to its original position when the camshaft rotates further.

Commonly, the second end of the rocker arm bearing against the valve stem bearing surface has a wear element for pushing against the valve stem bearing surface. Typically, a slight spacing is maintained between the wear element of the rocker arm and the valve stem bearing surface. This desired spacing—referred to as the valve lash distance—typically varies with the engine manufacturer and end use. For example, in a diesel engine, for an air intake valve, the preferred valve lash distance may be 0.012 inch, while for an exhaust valve, the desired valve lash distance may be 0.018 inch, for example. For a lawnmower engine, the desired valve lash distance may be 0.020 inch for both air intake and exhaust valves. The valve lash distance is set by adjusting a set screw on the first end of the rocker arm to thereby raise or lower the second end of the rocker arm toward or away from the top bearing surface on the valve stem.

As the rocker arm operates, the rocker arm pivots the bearing surface through an arc. Thus, the wear surface of the rocker arm pushes against the bearing surface of the valve stem in a scuffing or scraping motion. Accordingly, the rocker arm wear surface contacts the valve stem bearing surface generally along a line. As the rocker arm wear surface wears, the valve lash distance increases beyond the desirable pre-set distance. This increased distance is generally referred to as excessive back lash. As the back lash increases beyond the desired spacing, engine operation can become noisy as there is additional space for the rocker arm to vibrate. In addition, with greater wear, the timing of the opening and closing of the cylinder valves becomes less exact, resulting in less efficient engine operation. Excessive back lash can also contribute to longevity and environmental problems.

One solution to the excessive back lash problem is to reduce wear by providing a ball and socket on the valve end of the rocker arm. An example of a rocker assembly with such a ball and socket design is shown in FIGS. 1 and 3–5. As shown in FIG. 1, the rocker assembly 10 includes a rocker arm 12 mounted on a base 14 that is mounted on an engine surface 15. A first end 16 of the rocker arm has a bearing element 18 juxtaposed with one end 20 of a push rod 22. The other end 24 of the push rod 22 bears against a cam 26 mounted on a camshaft 28. The camshaft 28 is rotated by a standard drive mechanism, such as a drive chain (not shown) driven by the engine crankshaft (not shown).

The rocker arm 12 also has a second end 30. At the second end 30, a rocker ball 32 is secured to the rocker arm 12. At least a part of the rocker ball 32 is received in a socket 33. The rocker arm 12 is pivotable on the base 14 about an axis 34 between the first end 16 and second end 30 of the rocker arm 12. As the first end 16 of the rocker arm 12 is pushed up by the push rod 22, the rocker arm is pivoted about the axis 34 to move the second end 30 of the rocker arm 12 and the rocker ball 32 through a path defining an arc.

As shown in FIGS. 3–5, the rocker ball 32 has a curved outer surface 36 with a center of curvature 38 and a bottom 40. The center of curvature 38 is between the bottom 40 of the rocker ball 32 and the second end 30 of the rocker arm 12. At least part of the rocker ball defines a portion of a sphere. A non-spherical neck or throat 37 extends up from the spherical portion 39 to an insert 41 received in a pocket in the second end 30 of the rocker arm 12.

As shown in FIGS. 3–5, the socket 33 has an exterior bearing surface 42 for bearing against a complementary valve bearing surface 44 for pushing the valve stem 45. The socket 33 also has an exterior non-bearing surface 46, an interior surface 48 and an annular top 50 with a central opening 52 to receive the rocker ball 32. The interior surface 48 of the socket 33 has a bearing surface 54 for contacting a portion of the rocker ball curved outer surface 36. The interior surface 48 of the socket 33 is curved, although not in a spherical shape. Instead, as in standard ball and socket joints, the interior surface 48 is shaped like a gothic arch, diverging from a low point 56 along a central axis 58. At the annular top 50 of the socket, the horizontal distance between opposing interior sides 60, 62 of the interior surface is greater than the diameter of the spherical part 39 of the rocker ball 32 so that the rocker ball may be inserted into the central opening 52.

To lubricate the interface of the exterior bearing surfaces of the socket and valve element, lubricant channels 70, 72 are machined in the rocker ball 32 and in the socket 33. Through these channels 70, 72, lubricant is delivered to the interface 74 of the socket exterior bearing surface 42 and the valve bearing surface 44.

In operation, the rocker ball and socket assembly have an at rest position, illustrated in FIG. 3. Initially, the rocker ball 32 may be canted slightly to one direction, with the central axis 75 of the rocker ball 32 defining an angle $\Phi$ with the central axis 58 of the socket 33. The central axis 58 of the socket is parallel to and slightly offset from the axis 77 of the valve stem 45. As the cam 26 pushes up on the push rod 22, the first end 16 of the rocker arm 12 is raised, pivoting the rocker arm 12 about its axis 34. As the rocker arm 12 pivots, the second end 30 of the rocker arm is pushed downward, moving the rocker ball 32 through a curved path. As the rocker ball 32 is thus moved, it pivots in the socket 33. As the rocker arm is pivoted about the axis 34, the rocker ball 32 and socket 33 pass through an interim position, shown in FIG. 4, wherein the central axis 58 of the socket 33 is aligned to be co-linear with the central axis 75 of the rocker ball 32.

At the interim position, the socket bearing surface 42 has slid across the valve bearing surface 44, as shown. The axes 58, 75 remain generally parallel with the central axis 77 of the valve stem 45. As the cam 26 pushes the push rod 22 further upward, the first end 16 of the rocker arm 12 is raised higher, and the second end 30 of the rocker arm 12 is pushed further downward, causing further pivoting of the rocker ball 32, and linear and sliding movement of the socket 33. These changes in position are illustrated in FIG. 5, wherein the central axis 75 of the rocker ball is pivoted to define an angle θ with the central axis 58 of the socket. The curved outer surface 36 of the rocker ball 32 bears against the bearing surface 54 of the interior surface 48 of the socket, pushing the socket 33 downward, and thus pushing the exterior bearing surface 42 of the socket against the complementary bearing surface 44 of the valve stem 45. As shown in FIG. 5, the central axis 58 of the socket remains parallel with the central axis 77 of the valve stem 45. Thus, the pivoting motion of the rocker arm 12 is translated to linear and sliding movement of the socket 33 and linear movement of the valve stem 45. Lubrication of the interface 74 limits wear of the contacting bearing surfaces 42, 44. Since the spherical or curved portion 39 of the rocker ball 32 and interior surface 48 of the socket 33 have different shapes, the contact between the rocker ball and the interior surface of the socket is along a segment of the interior surface of the socket and a segment of the spherical portion of the rocker ball. This segment of the socket interior surface is the bearing surface shown at 54 in FIGS. 3–5.

As the valve stem 45 is pushed downward, the valve 47 is unseated from its seat in the head of the engine cylinder 49 (see FIG. 1). The cylinder 49 bears a conventional piston 51 and has a conventional fuel inlet 53. The valve 47 may be either for intake of air or a fuel-air mixture into the cylinder 49 or for exhaust from the cylinder 49.

The ball and socket design is advantageous in that larger bearing surfaces are provided at the interface 74 of the rocker arm and valve stem 45. In addition, the space between the bearing surfaces 42, 44 at the interface 74 allows for an oil film layer to develop between the bearing surfaces 42, 44 to reduce wear. Since the pivoting motion of the rocker arm 12 is translated into sliding and linear motion of the rocker arm socket 33, and thereby into linear movement of the valve stem 45, the flat-against-flat orientation of the socket and valve bearing surfaces 42, 44 is maintained throughout the pivoting motion of the rocker arm 12, maintaining the large surface area of contact.

There are, however, disadvantages associated with the conventional ball and socket design. These disadvantages relate to the problem of retaining the socket 33 on the rocker ball 32 until the rocker assembly 10 is mounted on the engine 15. Generally, to retain the socket 33 on the rocker ball 32, the socket 33 has been designed to extend from below the bottom 40 of the rocker ball up beyond the diameter 76 of the spherical curved part 39 of the rocker ball, and a retainer 66 has been inserted in the interior of the upper end of the socket 33 to retain the socket on the rocker ball. Resilient members, such as O-rings and metal springs have been used as retainers, and have been inserted in a groove 64 in the interior surface 48 of the socket 33. The rocker ball 32 has been pushed past the resilient retainer 66 into position, and the resilient retainer then should return to its shape defining a diameter less than the diameter of the rocker ball 32 to retain the socket on the rocker ball. Metal spring retainers have included flats 68 to define a spacing less than the diameter 76 of the spherical part 39 of the rocker ball 32. These designs have been problematic and expensive: machining the metal slug for the socket 33 to form the depressed interior surface 48 is expensive, and machining the groove 64 in the interior surface 48 of the socket 33 requires a second expensive machining operation. Use of rubber O-rings as retainers has allowed some of the sockets 33 to fall off of the rocker balls 32. Both the O-ring retainers and the metal spring retainers have proven difficult to install in an automated operation. If a metal spring is not properly installed, not only could the socket fall off of the rocker ball, but the metal spring could be deformed in the pressing operation if not properly positioned.

In addition, to provide lubricant to the interface of the socket exterior bearing surface and the valve stem bearing surface, the channels 70, 72 have been machined into the rocker balls and sockets in yet another machining operation. All of these machining operations have added to the cost of the rocker assemblies.

SUMMARY OF THE INVENTION

The present invention provides an improved rocker assembly that retains the benefits of the ball and socket design but is less expensive to produce and less prone to failure. The present invention also provides a method of assembling rocker arms that is more efficient than prior art methods. One embodiment of the present invention provides the additional advantage of providing channels for the delivery of lubricant from the rocker ball, around the socket, and to the interface of the bearing surfaces of the rocker arm and valve stem, reducing the amount of machining required. Another embodiment of the invention provides an alternate delivery path for lubricant. Another embodiment of the present invention provides the additional advantage of providing a rocker arm assembly that allows for simplified setting of the valve lash distance, and a simplified method of setting the valve lash distance.

In one aspect, the present invention provides an improved rocker assembly. The rocker assembly is of the type serving to open a valve in an engine. The rocker assembly has a rocker arm with a first end and a second end. The rocker assembly also includes a rocker ball secured to the second end of the rocker arm, a socket and a retainer. The rocker arm is pivotable about an axis between the first and second ends to move the second end to open the valve. The rocker ball has a central longitudinal axis and a curved outer surface with a center of curvature and a bottom. The center of curvature is between the bottom of the rocker ball and the second end of the rocker arm. The socket has a central longitudinal axis, an exterior bearing surface to act against a valve bearing surface for opening the valve, an exterior non-bearing surface, an interior surface and a top with a central opening to receive the rocker ball. The interior surface of the socket includes an interior bearing surface for contacting a portion of the rocker ball curved outer surface. In the improved rocker assembly of this aspect of the invention, the retainer comprises a resilient element secured to the socket and extending beyond the socket to a position between the top of the socket and the rocker arm. The center of curvature of the rocker ball is between the bottom of the rocker ball and a plane through at least part of the resilient retainer. The rocker ball and socket are capable of relative movement and have a range of relative motion. There is a bottom ball plane through the bottom of the rocker ball and perpendicular to the central longitudinal axis of the rocker ball. Contact between the retainer and any other element above the bottom ball plane is limited to contact between the retainer and the socket during at least one part of the range of relative motion.

In another aspect, the present invention provides an improved rocker assembly. The rocker assembly is of the type serving to open a valve in an engine. The rocker assembly includes a rocker arm with a first end and a second end. The rocker assembly further includes a rocker ball secured to the second end of the rocker arm, a socket and a retainer. The rocker arm is pivotable about an axis between the first and second ends to move the second end to open the valve. The rocker ball has a curved outer surface with a center of curvature and a bottom. The center of curvature of the rocker ball is between the bottom of the rocker ball and the second end of the rocker arm. The socket has a central longitudinal axis, an exterior bearing surface to act against a valve bearing surface for opening the valve, an exterior non-bearing surface, an interior surface and a top with a central opening to receive the rocker ball. The interior surface of the socket includes an interior bearing surface for contacting a portion of the rocker ball curved outer surface. In the improved rocker assembly of this aspect of the invention, the socket comprises a metal component wherein the interior surface of the socket is formed in a cold heading operation. The interior surface of the socket has a shape different from the shape of the rocker ball curved outer surface. The interior surface of the socket includes a portion below the interior bearing surface of the socket that is spaced from the rocker ball throughout the range of motion of the rocker ball.

In another aspect, the present invention provides an improved rocker assembly. The rocker assembly is of the type serving to open a valve in an engine. The rocker assembly has a rocker arm with a first end and a second end, and includes a rocker ball secured to the second end of the rocker arm, a socket and a retainer. The rocker arm is pivotable about an axis between the first and second ends to move the second end to open the valve. The rocker ball has a central longitudinal axis, a curved outer surface with a center of curvature and a bottom. The center of curvature of the rocker ball is between the bottom of the rocker ball and the second end of the rocker arm. The socket has a central longitudinal axis, an exterior bearing surface to act against a valve bearing surface for opening the valve, an exterior non-bearing surface, an interior surface and a top with a central opening to receive the rocker ball. The interior surface of the socket includes an interior bearing surface for contacting a portion of the rocker ball curved outer surface. The exterior non-bearing surface of the socket has an outer diameter. The rocker ball and socket have a range of relative motion wherein the central longitudinal axis of the socket is co-linear with the central longitudinal axis of the rocker ball at one point in the range of relative motion and wherein the central longitudinal axis of the rocker ball intersects the central longitudinal axis of the socket at an angle at another point in the range of relative motion. In the improved rocker assembly, the retainer comprises a polymeric material selected from the group consisting of thermoset resins, thermoplastic resins and epoxy resins. The retainer has a top with a central opening. The central opening of the top of the retainer has an inner diameter less than the twice the radius of curvature of the rocker ball and less than the smallest outer diameter of the socket. The top of the retainer is between the rocker arm and a plane through the center of curvature of the rocker ball and perpendicular to the central longitudinal axis of the rocker ball when the central longitudinal axis of the rocker ball is co-linear with the central longitudinal axis of the socket. The retainer is spaced from the rocker arm during at least part of the range of relative motion.

In another aspect, the invention provides an improved rocker assembly. The rocker assembly is of the type serving to open a valve in an engine. The rocker assembly includes a rocker arm with a first end to be driven by a push rod and a second end. The rocker assembly further includes a rocker ball secured to the second end of the rocker arm and a socket on the rocker ball. The rocker arm is pivotable about an axis between the first and second ends so that as the first end is pushed by the push rod the rocker arm pivots about the axis to move the second end to open the valve. The rocker ball has a curved outer surface with a center of curvature and a bottom. The center of curvature is between the bottom of the rocker ball and the second end of the rocker arm. The socket has an exterior bearing surface to act against a valve bearing surface for opening the valve. The socket also has an exterior non-bearing surface, an interior surface and a top with a central opening to receive the rocker ball. The interior surface of the socket includes an interior bearing surface for contacting a portion of the rocker ball curved outer surface so that pivoting motion of the rocker arm can be translated to linear movement of the socket against the valve bearing surface. The rocker assembly further includes a retainer for securing the socket on the rocker ball. In the improved rocker assembly of this aspect of the present invention, the retainer extends to the level of the exterior bearing surface of the socket and includes a channel for the delivery of lubricant to the exterior bearing surface of the socket.

In another aspect, the present invention provides an improved rocker assembly for opening a valve in an engine. The rocker assembly has a rocker arm with a first end and a second end. The rocker assembly further includes a rocker ball secured to the second end of the rocker arm and a socket adjacent to the rocker ball. The rocker arm is pivotable about an axis between the first and second ends to move the second end to open the valve. The rocker ball has a curved outer surface with a center of curvature and a bottom, the center of curvature being between the bottom of the rocker ball and the second end of the rocker arm. The socket has an exterior bearing surface to act against a valve bearing surface for pushing the valve, an exterior non-bearing surface, an interior surface and a top with a central opening to receive the rocker ball. The interior surface of the socket includes an interior bearing surface for contacting a portion of the rocker ball curved outer surface so that pivoting motion of the rocker arm can be translated to linear movement of the socket against the valve bearing surface. The rocker assembly further includes a retainer for securing the socket to the rocker ball. In the improved rocker assembly of this aspect of the present invention, the retainer includes a spacer beyond the level of the exterior bearing surface of the socket for setting a desired spacing between the exterior bearing surface of the socket and the valve bearing surface for setting the valve lash distance. At least a part of the retainer is connected to the spacer.

In another aspect, the present invention provides a method of setting valve lash distance. A rocker assembly for opening a valve in an engine is provided. The rocker assembly has a rocker arm with a first end to be driven by a push rod and a second end. The rocker assembly further includes a rocker ball secured to the second end of the rocker arm, a socket on the rocker ball and a valve lash set mechanism. The rocker arm is pivotable about an axis between the first and second ends so that as the first end is pushed by the push rod the rocker arm pivots about the axis to move the second end to open the valve. The rocker ball has a curved outer surface with a center of curvature and a bottom. The center of curvature is between the bottom of the rocker ball and the second end of the rocker arm. The socket has an exterior bearing surface to act against a valve bearing surface for pushing the valve, an exterior non-bearing surface, an interior surface and a top with a central opening to receive the rocker ball. The interior surface of the socket includes an interior bearing surface for contacting a portion of the rocker ball curved outer surface so that pivoting motion of the rocker arm can be translated to linear movement of the socket against the valve bearing surface. The rocker assembly also includes a retainer for securing the socket on the rocker ball. The retainer includes a spacer beyond the level of the exterior bearing surface of the socket for setting a desired spacing between the exterior bearing surface of the socket and the valve bearing surface for setting the valve lash distance. The method comprises the acts of placing the retainer spacer against the valve bearing surface, adjusting the set mechanism to fix the distance between the exterior bearing surface of the socket and the valve bearing surface, and moving the retainer spacer out of contact with the valve bearing surface after the distance is fixed. The socket has a central longitudinal axis perpendicular to the exterior bearing surface of the socket and the act of moving the retainer spacer comprises moving the retainer along the central longitudinal axis of the socket away from the valve bearing surface.

In another aspect, the present invention provides a rocker assembly for opening a valve in an engine. The rocker assembly has a rocker arm with a first end and a second end, a rocker ball secured to the second end of the rocker arm, a socket and a retainer. The rocker arm is pivotable about an axis between the first and second ends to move the second end to open the valve. The rocker ball has a curved outer surface with a center of curvature and a bottom, the center of curvature being between the bottom of the rocker ball and the second end of the rocker arm. The socket has an exterior bearing surface to act against a valve bearing surface for opening the valve, an exterior non-bearing surface, an interior surface and a top with a central opening to receive the rocker ball. The interior surface of the socket includes an interior bearing surface for contacting a portion of the rocker ball curved outer surface. In this aspect of the invention, a method of assembling the rocker components is provided. The method includes securing the retainer to the socket with at least part of the retainer being outside of the socket, inserting the rocker ball through the retainer while the part of the retainer is outside of the socket and pushing the rocker ball through the part of the retainer outside of the socket until the center of curvature of the rocker ball has passed the part of the retainer outside of the socket. After assembly the socket and the retainer can pivot relative to the rocker ball without distorting the retainer.

In another aspect, the present invention provides a rocker assembly for opening a valve in an engine. The rocker assembly has a rocker arm with a first end and a second end, a rocker ball secured to the second end of the rocker arm, a socket and a retainer. The rocker arm is pivotable about an axis between the first and second ends to move the rocker ball relative to the socket. The rocker ball has a central longitudinal axis and a curved outer surface with a center of curvature and a bottom. The center of curvature of the rocker ball is between the bottom of the rocker ball and the second end of the rocker arm along the central longitudinal axis. The socket has a central longitudinal axis, an exterior bearing surface to act against a valve bearing surface for opening the valve, an exterior non-bearing surface, an interior surface and a top with a central opening to receive the rocker ball. The interior surface of the socket includes an interior bearing surface for contacting a portion of the rocker ball curved outer surface. In the improved rocker assembly of this aspect of the invention, retainer comprises a resilient element secured to the socket and extending beyond the socket to a position between the top of the socket and the rocker arm. The retainer has a top having an interior surface. A plane through the interior surface of the top of the retainer is spaced above a plane through the top of the socket. The retainer is spaced from the rocker arm. The rocker arm and rocker ball are free from contact with the retainer during at least part of the relative movement of the rocker ball and socket.

In another aspect, the present invention provides a rocker assembly for opening a valve in an engine. The rocker assembly has a rocker arm with a first end and a second end, a rocker ball secured to the second end of the rocker arm, a socket and a retainer. The rocker arm is pivotable about an axis between the first and second ends to move the rocker ball relative to the socket. The rocker ball has a curved outer surface with a center of curvature and a bottom. The center of curvature of the rocker arm is between the bottom of the rocker ball and the second end of the rocker arm. The socket has an exterior bearing surface to act against a valve bearing surface for opening the valve, an exterior non-bearing surface, an interior surface and a top with a central opening to receive the rocker ball. The interior surface of the socket includes an interior bearing surface for contacting a portion of the rocker ball curved outer surface. The socket has a height from the level of the exterior bearing surface to the level of the top of the socket. In the improved rocker assembly, the retainer comprises a resilient element secured to the socket and extending from the level of the exterior bearing surface of the socket toward the top of the socket. The retainer is shaped and sized to keep the socket and the rocker ball together and to allow relative motion between the rocker ball and the socket as the rocker arm pivots.

In another aspect, the present invention provides a method of setting valve lash distance. A rocker assembly for opening a valve in an engine is provided. The rocker assembly has a rocker arm with a first end to be driven by a push rod and a second end. The rocker assembly further includes a rocker ball secured to the second end of the rocker arm, a socket, a retainer and a set mechanism. The rocker arm is pivotable about an axis between the first and second ends so that as the first end is pushed by the push rod the rocker arm pivots about the axis to move the second end to open the valve. The rocker ball has a curved outer surface with a center of curvature and a bottom. The center of curvature of the rocker ball is between the bottom of the rocker ball and the second end of the rocker arm. The socket has an exterior bearing surface to act against a valve bearing surface for pushing the valve, an exterior non-bearing surface, an interior surface and a top with a central opening to receive the rocker ball. The interior surface of the socket includes an interior bearing surface for contacting a portion of the rocker ball curved outer surface. The retainer is sized and shaped to keep the socket and the rocker ball together and includes a side and a spacer connected to the side. The spacer is beyond the level of the exterior bearing surface of the socket. The spacer is provided for setting a desired spacing between the exterior bearing surface of the socket and the valve bearing surface for setting the valve lash distance. The method includes the acts of placing the retainer spacer against the valve bearing surface, adjusting the set mechanism to fix the distance between the exterior bearing surface of the socket and the valve bearing surface, detaching the retainer spacer from the retainer side and moving the retainer spacer out of contact with the valve bearing surface after the distance is fixed.

In another aspect the present invention provides an improved rocker assembly for opening a valve in an engine. The rocker assembly has a rocker arm with a first end and a second end, a rocker ball secured to the second end of the rocker arm, a socket and a retainer. The rocker arm is pivotable about an axis between the first and second ends. The rocker ball has a curved outer surface with a center of curvature and a bottom. The center of curvature of the rocker ball is between the bottom of the rocker ball and the second end of the rocker arm. The socket has a central longitudinal axis, an exterior bearing surface to act against a valve bearing surface for opening the valve, an exterior non-bearing surface, an interior surface and a top with a central opening to receive the rocker ball. The interior surface of the socket includes an interior bearing surface for contacting a portion of the rocker ball curved outer surface. The socket is made of powder metal and the interior bearing surface of the socket is formed in a pressing operation.

In another aspect, the present invention provides a rocker assembly for opening a valve in an engine. The rocker assembly has a rocker arm with a first end and a second end, a rocker ball secured to the second end of the rocker arm, a socket and a retainer. The rocker arm is pivotable about an axis between the first and second ends. The rocker ball has a curved outer surface with a center of curvature and a bottom. The center of curvature of the rocker ball is between the bottom of the rocker ball and the second end of the rocker arm. The socket has a central longitudinal axis, an exterior bearing surface to act against a valve bearing surface for opening the valve, an exterior non-bearing surface, an interior surface and a top with a central opening to receive the rocker ball. The interior surface of the socket includes an interior bearing surface for contacting a portion of the rocker ball curved outer surface. The socket has a height from the top to the exterior bearing surface. The exterior non-bearing surface of the socket extends upward from the exterior bearing surface to the top and has a uniform outer diameter from the top to the exterior bearing surface. The retainer comprises a resilient material and has a side with a height. The side of the retainer has an interior surface and a uniform inner diameter through the height of the side. The interior surface of the retainer is positioned against the exterior non-bearing surface of the socket along at least part of the height of the socket and at least part of the height of the side of the retainer.

BRIEF DESCRIPTION OF THE DRAWINGS

The invention will be described in conjunction with the attached drawings, in which like reference numerals have been used for like parts and in which.

DETAILED DESCRIPTION

Figure 1:
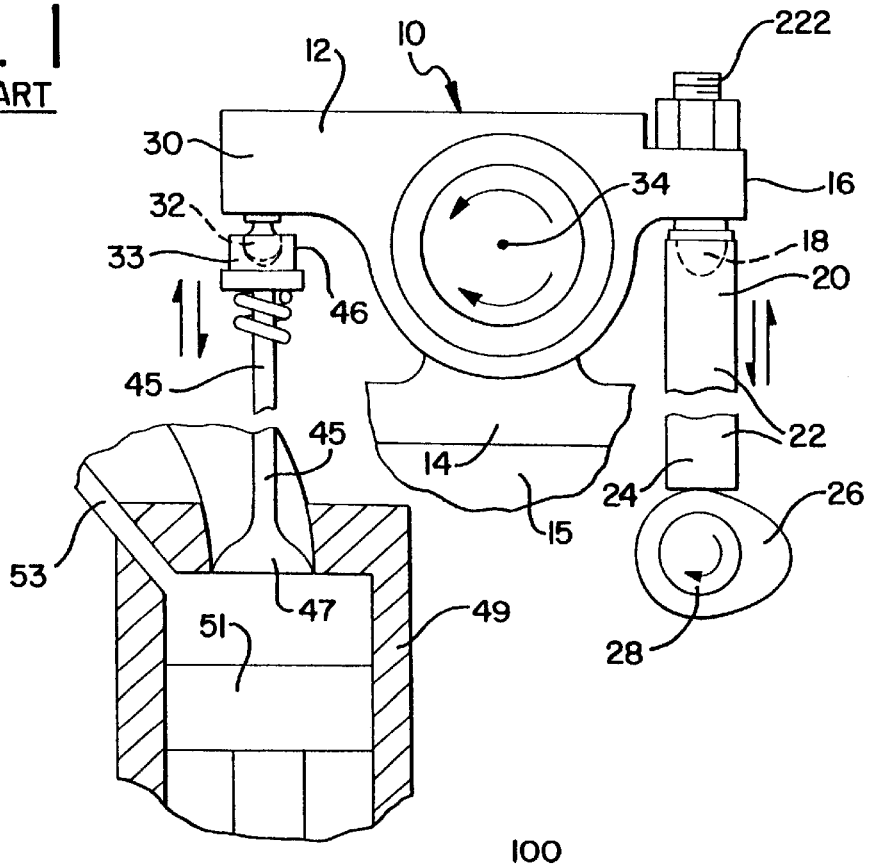
FIG. 1 PRIOR ART
FIG. 1 is a schematic elevation of a prior art rocker assembly mounted on an engine, showing a piston cylinder in cross-section.
Figure 2:
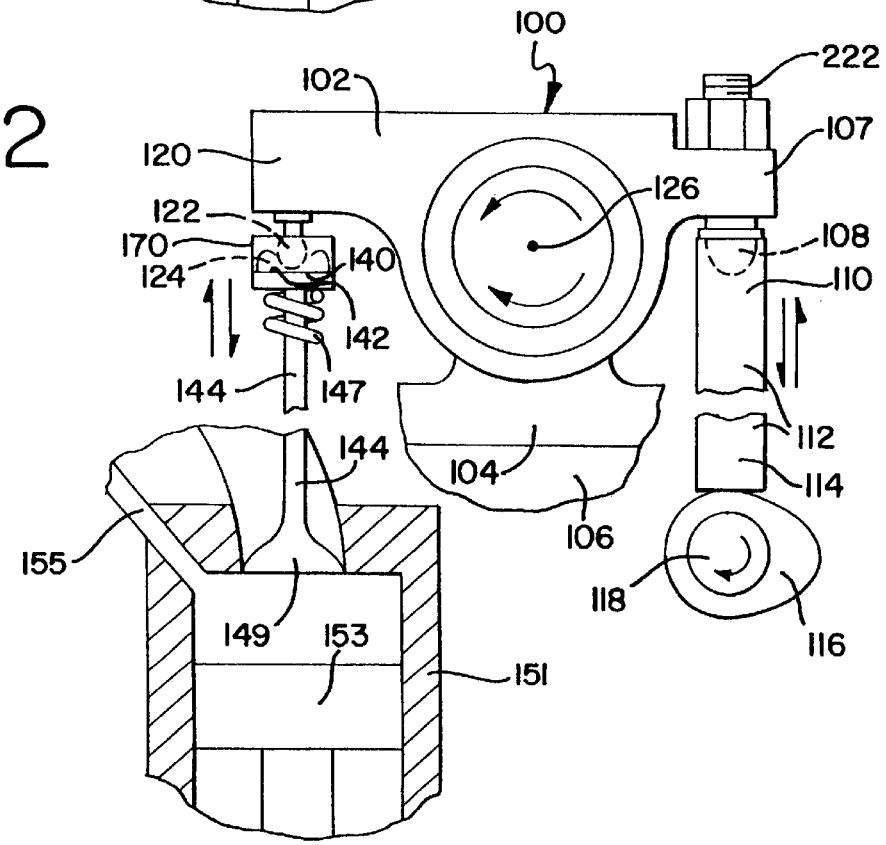
FIG. 2 is a schematic elevation of an embodiment of a rocker assembly of the present invention mounted on an engine, showing a piston cylinder in cross-section.

A first rocker assembly 100 incorporating the features of the present invention is illustrated in FIGS. 2 and 6–8. As shown in FIG. 2, the rocker assembly 100 of the present invention includes a rocker arm 102 mounted on a base 104 that is mounted on an engine surface 106. A first end 107 of the rocker arm 102 has a bearing element 108 juxtaposed with one end 110 of a push rod 112. The other end 114 of the push rod 112 bears against a cam 116 mounted on a camshaft 118. As in standard engines, the camshaft 118 is rotated by a standard drive mechanism, such as a drive chain (not shown) driven by the engine crankshaft (not shown).

The rocker arm 102 has a second end 120. At the second end 120, a rocker ball 122 is secured to the rocker arm 102. At least part of the rocker ball 122 is received in a socket 124. The rocker arm 102 is pivotable on the base 104 about an axis 126 between its first end 107 and second end 120.

Figure 6:
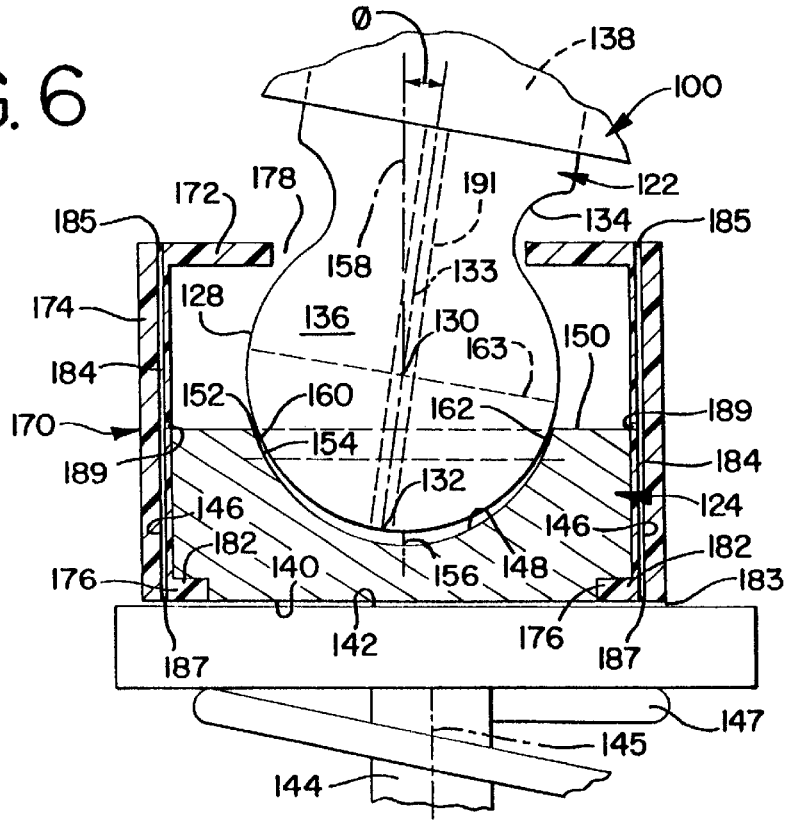
FIG. 6 is an enlarged elevation of the one end of the rocker assembly of the embodiment of the present invention shown in FIG. 2, with the socket shown in cross-section and the rocker ball and socket in an initial at-rest position.
Figure 7:
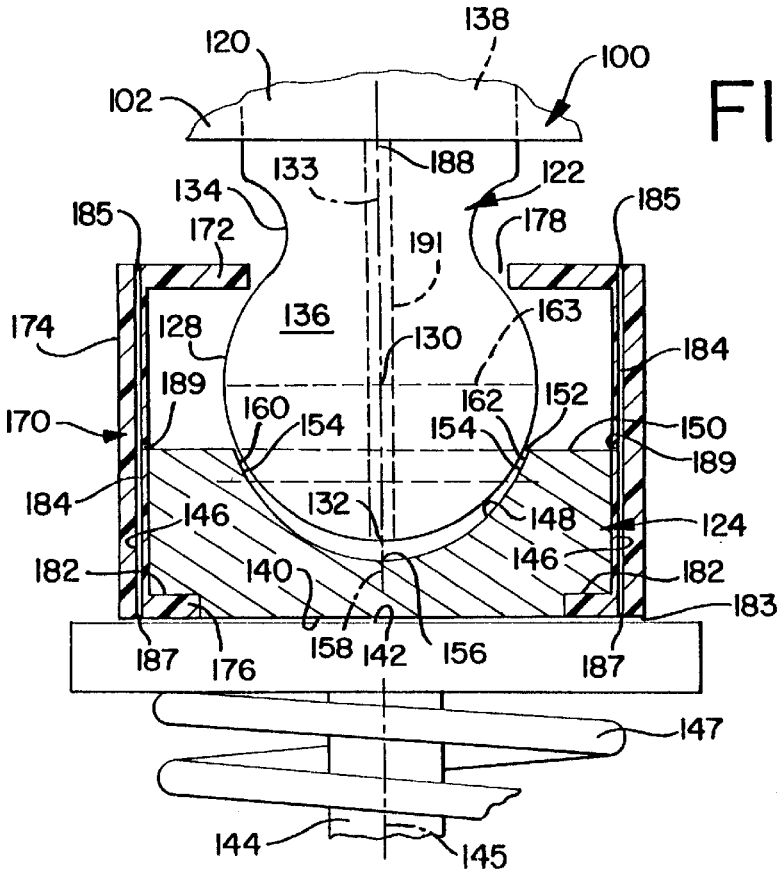
FIG. 7 is an elevation of the rocker assembly of FIG. 6, shown with the rocker arm and rocker ball pivoted to an interim position, and with the socket and valve stem moved to an interim position.
Figure 8:
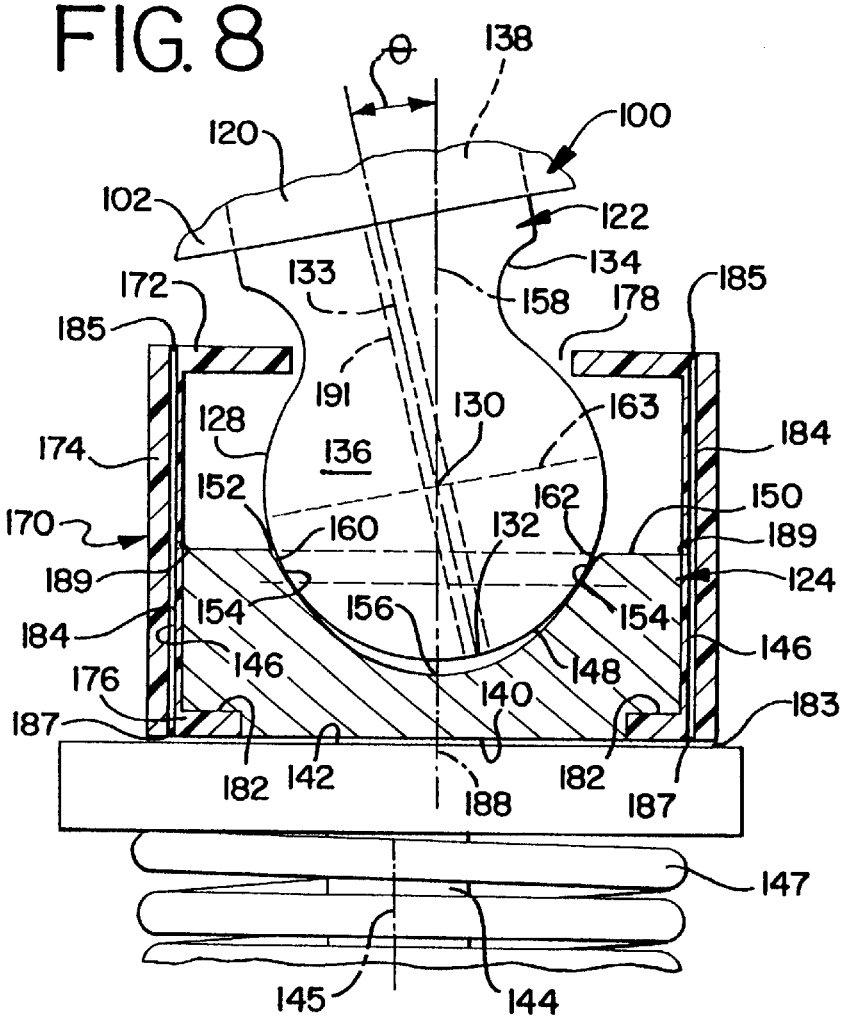
FIG. 8 is an elevation of the rocker assembly of FIG. 6, shown with the rocker arm and rocker ball pivoted to a further position, and with the socket and valve stem moved to a further position to open the valve into the piston cylinder.
Figure 9:
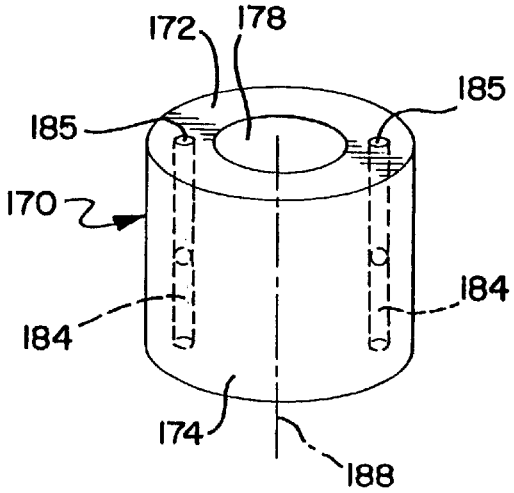
FIG. 9 is a perspective view of the first embodiment of the resilient retainer of the present invention.
Figure 10:
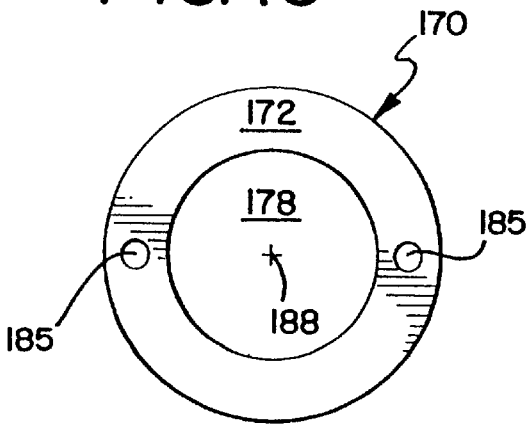
FIG. 10 is a top plan view of the resilient retainer of FIG. 9.

As shown in FIGS. 6–8, the rocker ball 122 has a curved outer surface 128 with a center of curvature 130, a bottom 132 and a central axis 133. The center of curvature 130 is between the bottom 132 of the rocker ball 122 and the second end 120 of the rocker arm 102. At least part of the rocker ball defines a portion of a sphere. A non-spherical neck 134 extends up from the spherical portion 136 to an insert 138 received in a mating pocket in the second end 120 of the rocker arm 102. The center of curvature 130 and bottom 132 of the rocker ball are both aligned along the central axis 133.

Figure 3:
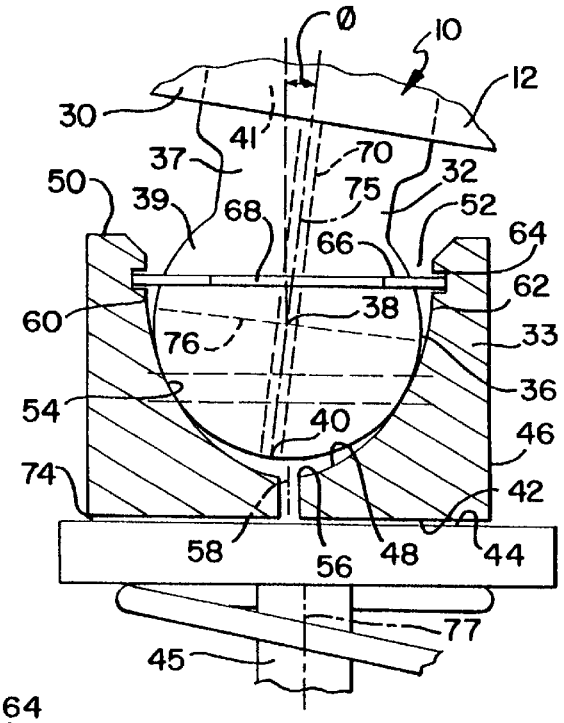
FIG. 3 PRIOR ART
FIG. 3 is an enlarged elevation of one end of the prior art rocker assembly of FIG. 1, with the socket shown in cross-section and with the rocker ball and socket in an initial at-rest position.

As shown in FIGS. 6–8, the socket 124 has an exterior bearing surface 140 to act against a complementary valve bearing surface 142 for pushing the valve stem 144 to open the valve. The socket also has an exterior non-bearing surface 146, an interior surface 148 and an annular top 150 with a central opening 152 to receive at least part of the rocker ball 122. The interior surface 148 of the socket 124 has a bearing surface 154 for contacting a portion of the rocker ball curved outer surface 128. The interior surface 148 of the socket defines a curved depression, although generally not in a spherical shape in the illustrated embodiment. Instead, as in the illustrated prior art ball and socket of FIGS. 3–5, the depressed interior surface 148 is shaped like a gothic arch, diverging from a low point or base 156 along a central axis 158. The low point 156 is spaced furthest from the level of the top 150 of the socket. But unlike the prior art socket of FIGS. 1 and 3–5, in the first illustrated embodiment of the present invention, at the annular top 150 of the socket, the maximum horizontal distance between the opposing sides 160, 162 of the depressed interior surface 148, that is, the cross-dimension of the opening 152 in the socket, is less than the diameter 163 of the rocker ball 122.

Instead of acting directly to open a single valve, the rocker assembly 100 may be designed to operate against a pair of valves, or more than two valves. In such a case, the socket exterior bearing surface 140 may act against a bearing surface of a bridge element that operates more than one valve. The expression "valve bearing surface" as used herein is intended to encompass both a surface such as the individual surface 142 shown in FIGS. 6–8, as well as a bearing surface of a bridge element that spans more than one valve.

Figure 4:
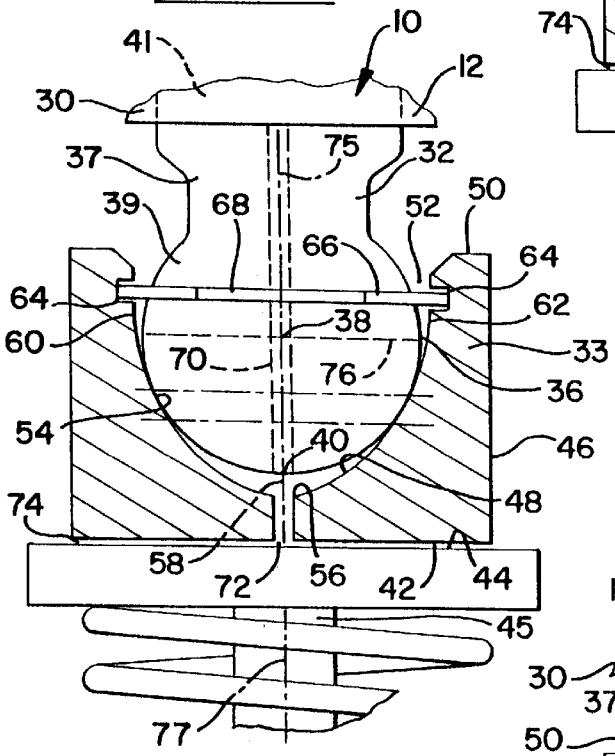
FIG. 4 PRIOR ART
FIG. 4 is an elevation of the prior art rocker assembly of FIG. 3, shown with the rocker arm and rocker ball pivoted to an interim position.
Figure 5:
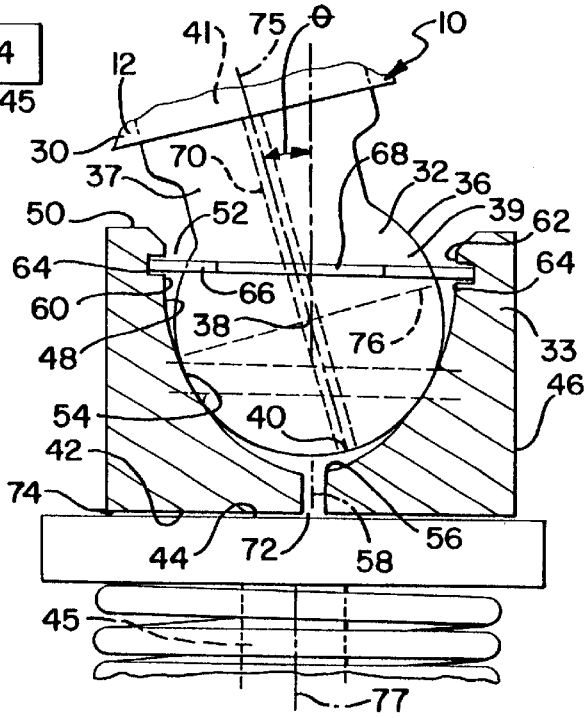
FIG. 5 PRIOR ART
FIG. 5 is an elevation of the prior art rocker assembly of FIG. 3, shown with the rocker arm and rocker ball pivoted to open the valve into the piston cylinder.

The socket 124 of the first illustrated embodiment of the present invention is much shallower than the socket 33 of the prior art. This difference can be seen from a comparison of the illustrated prior art of FIGS. 3–5 with the first illustrated embodiment of the present invention of FIGS. 6–8. In each case, the bearing surface of the socket interior surface comprises a segment, designated 54 in the prior art and designated 154 in the embodiment of FIGS. 6–8. In the prior art of FIGS. 3–5, the top 50 of the socket is substantially above the bearing surface 54; when the ball and socket are aligned as shown in FIG. 4 with their central axes 75, 58, co-linear, the diameter 76 of the rocker ball 32 is between the top 50 of the socket 33 and the low point 56 of the interior surface 48 of the socket 33. But in the first illustrated embodiment of the present invention, the annular top 150 of the socket 124 is at the level of the top of the bearing surface segment 154 of the socket interior surface 148; when the rocker ball 122 and socket 124 are aligned with their central axes 133, 158 co-linear, the top 150 of the socket is between the diameter 163 of the rocker ball 122 and the base or low point 156 of the interior surface 148 of the socket.

The differences in the shapes of the sockets of the first embodiment of the present invention and the prior art are significant. In the prior art, the position of the retainer 66 depends upon the shape of the socket. For the prior art retainer 66 to be above the diameter 76 of the rocker ball, and for the spacing defined by the retainer 66 to be less than the diameter 76 of the rocker ball, the retainer is positioned above the diameter of the rocker ball, nearer to the second end 30 of the rocker arm 12. For the retainer 66 to be so positioned, the top 50 of the socket must also be above the diameter 76 of the rocker ball, and between the center of curvature 38 and the second end 30 of the rocker arm 12. But in the first illustrated embodiment of the present invention, the socket 124 does not need to extend to the same height because the sides of the interior surface of the socket do not function to position a retainer. Instead, the position of the retainer may be based upon an exterior feature of the socket, and can be based upon a feature of the exterior bearing surface 140 or the exterior non-bearing surface 146 of the socket 124. Accordingly, the interior surface 148 of the socket need only function as a bearing surface, and therefore the height of the socket may be based upon the position of the bearing segment 154.

Since the interior surface 148 of the socket 124 of the first illustrated embodiment of the present invention need not be as deep or high as the interior surface 48 of the socket 33 of the prior art, the first illustrated embodiment of the present invention allows for the use of less expensive methods of manufacture. Instead of machining the depressed interior surface 148 into a metal slug, the entire socket, including the depressed interior surface 148, can be made of powder metal with the depressed interior surface 148 formed in a pressing operation. It should be understood that the pressing operation could comprise part of the initial formation of the green powder metal compact, or could be part of a subsequent sizing or coining operation, or any other subsequent pressing operation. The socket of the first illustrated embodiment of the present invention could also be made by cold-forming or cold-heading the depressed interior surface 148 into a metal workpiece. Some machining of the interior surface may be done to provide a desired finish on the bearing segment 154, for example. Subsequent heat treatment and other standard processes may be used as well. Both of these methods of manufacture are less expensive than machining the entire depressed interior surface 148 into a metal slug.

The advantages associated with the socket of the first illustrated embodiment relate to the unique retainer 170 used in the rocker assembly 100. The first illustrated retainer 170 is a resilient element secured to the socket 124. The retainer 170 extends beyond the socket 124 to a position between the annular top of the socket 150 and the second end 120 of the rocker arm 102. The shape of the retainer 170 secures the socket 124 on the rocker ball 122. As shown in FIGS. 6–8, the first illustrated retainer 170 has an annular top 172, an integral cylindrical side 174 and an integral annular bottom 176. The retainer 170 also has a central longitudinal axis shown at 188 in FIGS. 7–10.

It should be understood that the resilient retainer 170 need not be made as an integral element. Any of the illustrated embodiments of resilient retainers 170, 208, 209, 210, 216, 229, 239, could be made of separate components connected in any conventional way. For example, the retainer could be made of top and bottom components combined through standard mechanical devices, such as snap-fitting, or through the use of sonic welding or adhesives. The retainer could also comprise a clam-shell design, for example, folded and locked around the socket element. It should be understood that these divisions and methods of combining components are provided by way of illustration only, and that the present invention is not limited to integrally-formed retainers, to any particular division of components or to any particular method of combining components unless expressly set forth in the claims.

The annular top 172 of the resilient retainer 170 has a central opening 178 through which a part of the rocker ball 122 extends, such as the neck 134 connecting the spherical portion 136 and the insert 138. The diameter of the central opening 178 is greater than the thickness of the neck 134 and less than the diameter 163 of the spherical portion 136 of the rocker ball 122. Since the retainer 170 is resilient, the top 172 may be deformed by the rocker ball 122 as the socket 124 is placed on the rocker ball 122, deforming to allow the rocker ball diameter 163 to pass through the opening 178 and then returning to its original shape to retain the socket 124 on the rocker ball 122 during normal storage and use.

In the first illustrated embodiment, the cylindrical side 174 of the resilient retainer 170 substantially surrounds the exterior non-bearing surface 146 of the socket 124. It should be understood that the side 174 of the resilient retainer need not be cylindrical, and that gaps may be provided if desired, although it may be desirable to provide sufficient coverage to seal the interface of the bearing surfaces of the rocker ball and socket against dirt, such as abrasive contaminants.

In the first illustrated embodiment, the annular bottom 176 of the resilient retainer 170 provides the means of securing the retainer 170 to the socket. The annular bottom 176 fits within a complementary annular undercut 182 in the socket 124. In the first illustrated embodiment, the undercut 182 is at the exterior bearing surface 140 of the socket 124.

It should be understood that the size of the bottom 176 could be different from that shown, and that the bottom could have other shapes as well. For example, the bottom could comprise an annular tab or a plurality of discrete tabs.

The resilient retainer 170 of the first illustrated embodiment has the advantage of providing a path for the delivery of lubricant to the interface 183 of the socket exterior bearing surface 140 and the valve bearing surface 142. In the first illustrated embodiment, the retainer 170 includes channels 184 from the top surface 172, through the side 174 and to the bottom 176. The channels 184 are in fluid communication with holes 185 in the top surface 172 of the resilient retainer 170 and with holes 187 in the bottom 176 of the retainer. The channels 184 are also in fluid communication with interior holes 189 in the interior of the side 174 of the resilient retainer 170; the holes 189 are at about the level of the top 150 of the socket 124. The channels 184 and the holes 185, 187, 189 provide flow paths for liquid lubricant to be delivered to the interface 183 of the socket exterior bearing surface 140 and the valve bearing surface 142. The channels 184 and holes 185, 187, 189 may be formed in the retainer 170 as the retainer is formed, such as by molding, or may be later cut or machined into the retainer. But since the retainer may be made of a softer material than the socket and rocker ball, formation of the channels 184 and holes 185, 187 should be significantly less expensive compared to the channels 70, 72 of the prior art rocker ball and socket.

In the embodiment of FIGS. 6–8, lubricant can flow through the rocker ball lubricant channel 191 to the interior surface 148 of the socket 124. The lubricant can be moved through the interior holes 189 leading into the channels 184, and from the channels 184 to the interface 183 of the bearing surfaces 140, 142. This design eliminates the need for a lubricant channel to be machined into the socket, thus saving expense. It should be understood that the channels 184 need not extend beyond the interior holes 189 to the top 172 of the retainer, but could extend solely from the interior holes 189 to the holes 187 at the bottom of the retainer.

Figure 13:
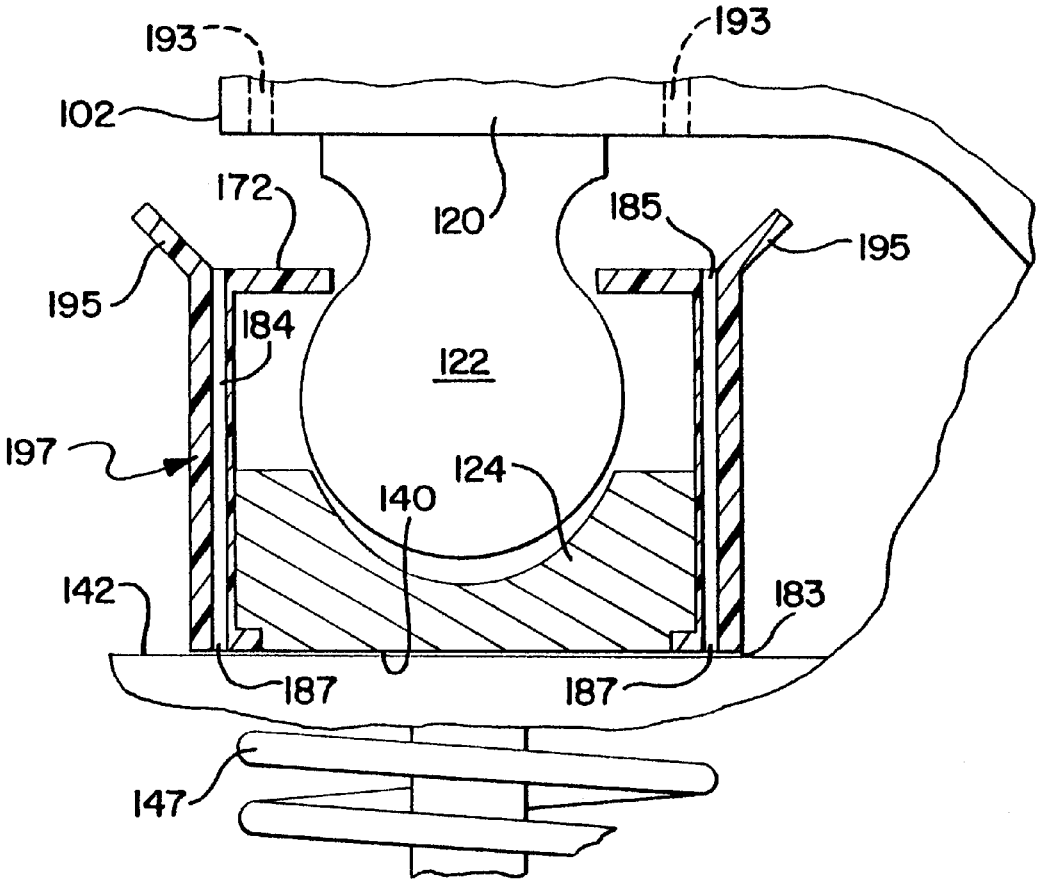
FIG. 13 is an enlarged elevation of one end of a rocker assembly of another embodiment of the present invention, with the socket and resilient member shown in cross-section.

Alternatively, as shown in FIG. 13 lubricant can be delivered through holes 193 in the second end of the rocker arm to drip around the rocker ball to the top of the resilient retainer 197. In FIG. 13, like reference numbers have been used for parts like those shown in the embodiment of FIGS. 2 and 6–10. In the embodiment of FIG. 13, the holes 185 in the top 172 of the retainer 197 may serve as entry holes for the lubricant. An annular flange 195 may be added around the retainer to catch dripping lubricant and direct it to the holes 185 in the top 172 of the retainer.

Figure 11:
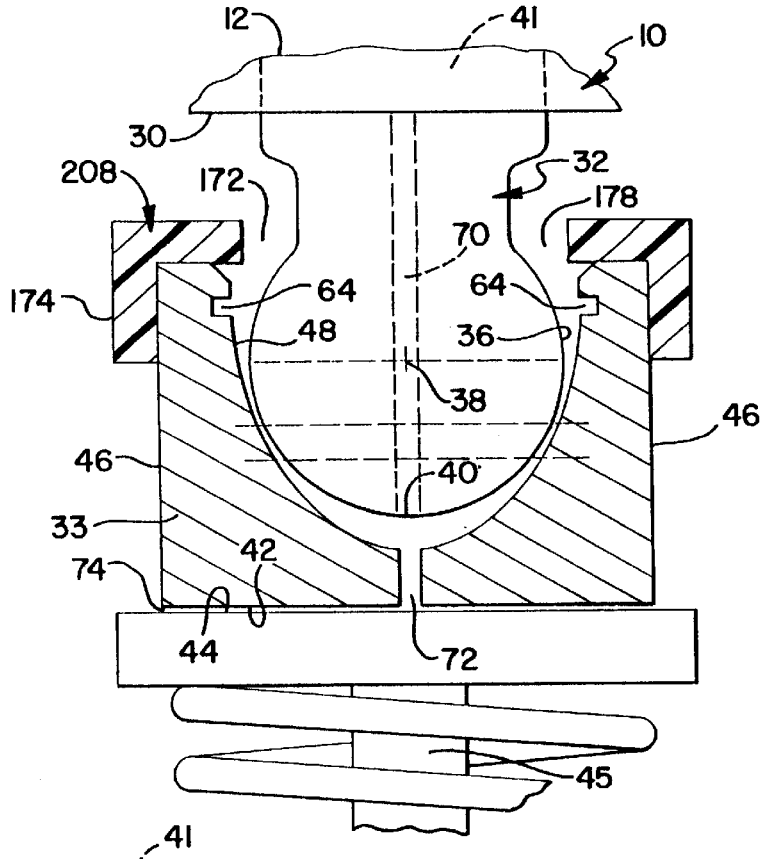
FIG. 11 is an enlarged elevation of one end of a rocker assembly of another embodiment of the present invention, with the socket and resilient member shown in cross-section.

An alternative embodiment of the present invention is illustrated in FIG. 11. In FIG. 11, like reference numbers have been used for parts like those shown in the embodiments of FIGS. 2 and 6–10. The resilient retainer 208 of the embodiment of FIG. 11 is illustrated assembled with a socket 33 of the type illustrated for the prior art assembly of FIGS. 3–5, and like reference numbers have been used. It should be understood that with some variation, the resilient retainer 208 of FIG. 11 may also be used with other types of sockets, such as the socket of the present invention illustrated in FIGS. 6–8. In the embodiment of FIG. 11, the inner diameter of the cylindrical side 174 of the resilient retainer 208 is about the same as the outer diameter of the socket 33 at the exterior non-bearing surface 46, so that an interference fit secures the resilient retainer 208 to the socket 33. It should be understood that the sides 174 of the resilient retainer may be extended down to the exterior bearing surface 42 of the socket, and that lubricant channels may be formed in the resilient retainer to deliver lubricant to the interface 74 of the bearing surfaces 42, 44 of the socket and the valve.

Figure 12:
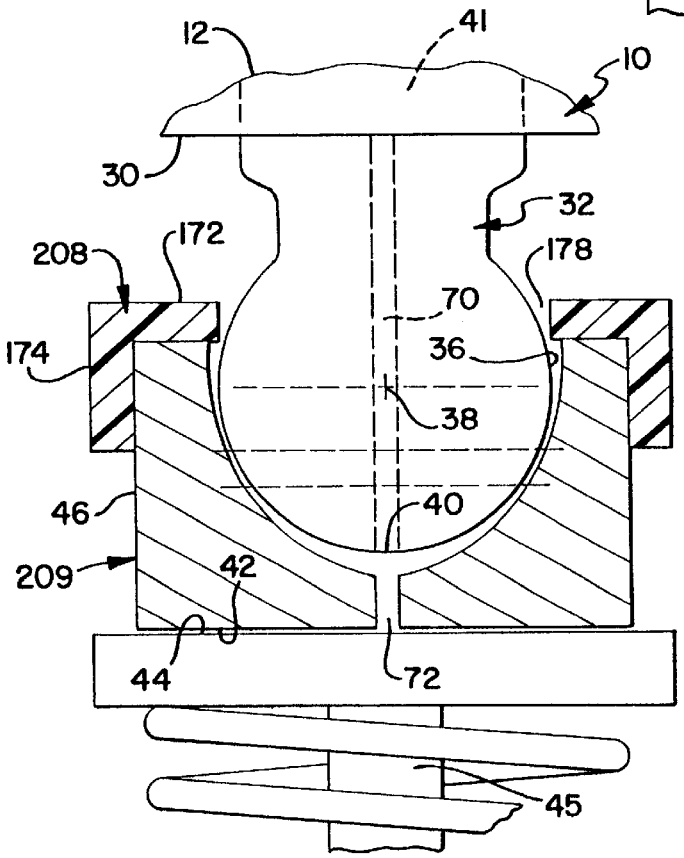
FIG. 12 is an enlarged elevation of one end of a rocker assembly of another embodiment of the present invention, with the socket and resilient member shown in cross-section.

The resilient retainer 208 of the FIG. 11 embodiment could also be used with a shortened socket, as shown in FIG. 12. This shortened socket 209 is similar to that shown in FIG. 11, but shortened to the level of the groove 64 in the prior art socket. The dimensions of the resilient retainer 208 could be varied for this design. Like reference numbers have been used in FIG. 12 for like parts of this embodiment, the first embodiment of FIGS. 2 and 6–10, and the prior art of FIGS. 1 and 3–5.

Figure 14:
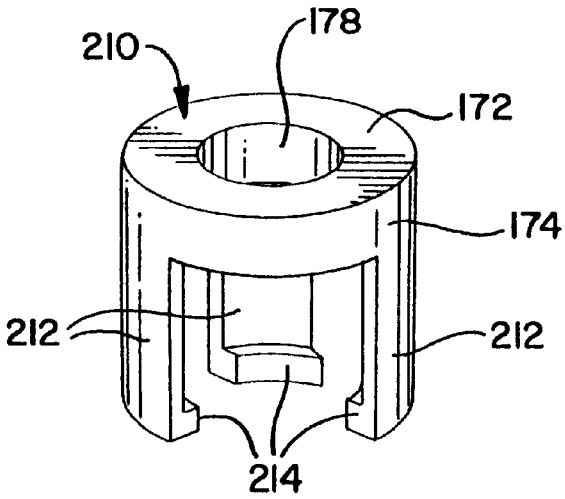
FIG. 14 is a perspective view of another alternate embodiment of a resilient retainer of the present invention.

Another alternative embodiment of a resilient retainer 210 is illustrated in FIG. 14. In FIG. 14, like reference numbers have been used for parts like those shown in the embodiment of FIGS. 2 and 6–10. In the embodiment of FIG. 14, the resilient retainer has a plurality of gripper fingers 212 with detents 214 to engage complementary recesses in one of the exterior surfaces of the socket (not shown) to secure the resilient retainer 210 on the socket. Complementary detents and recesses may be used to secure other embodiments of the resilient retainers and sockets as well. The recesses may be in the exterior non-bearing surface or the exterior bearing surface of the socket, for example.

Figure 15:
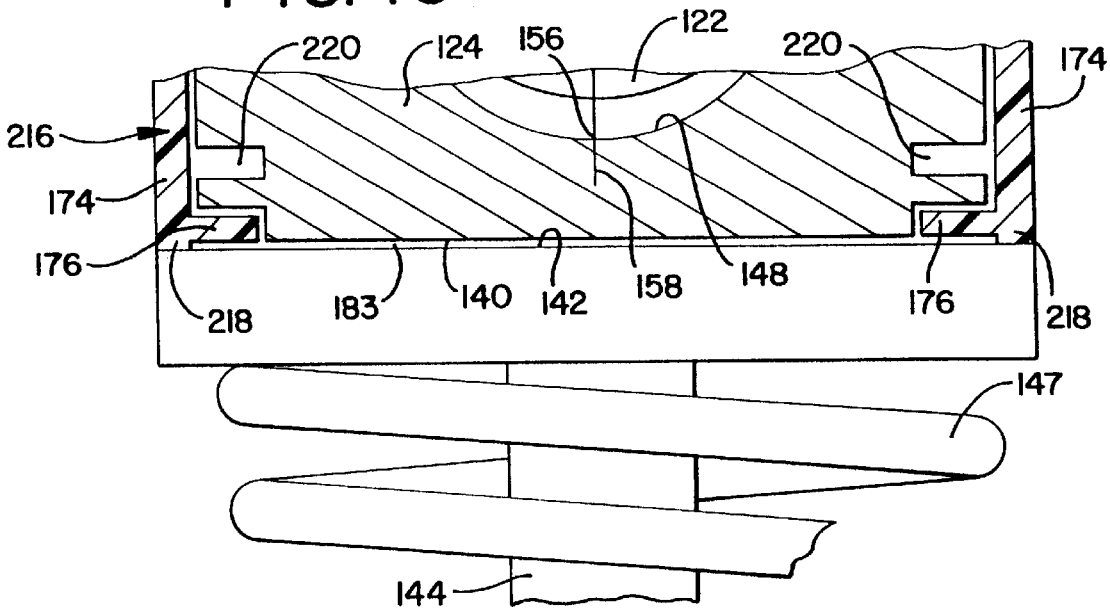
FIG. 15 is an enlarged elevation of a part of one end of another embodiment of a rocker assembly of the present invention showing a resilient retainer with a spacer for pre-setting valve lash distance, with the resilient retainer and socket shown in cross-section.

An additional feature may be used with the resilient retainer of any embodiment extending down to the level of the interface 183 between the exterior bearing surface 140 of the socket and the complementary bearing surface 142 of the valve 144. This additional feature is illustrated in FIG. 15 for the embodiment of FIGS. 2 and 6–10. In FIG. 15, like reference numbers have been used for parts like those shown in the embodiments of FIGS. 2 and 6–10. As shown in FIG. 15, the resilient retainer 216 of this embodiment has a cylindrical side 174 and an annular bottom 176 like the resilient retainer 170 of FIGS. 2 and 6–10. And like the resilient retainer 170 of the embodiment of FIGS. 6–10, the resilient retainer 216 of the embodiment of FIG. 15 may have an annular top 172 (not shown in FIG. 15) with an opening 178 of the type shown in either of FIGS. 10 or 11, for example.

In the embodiment of FIG. 15, the resilient retainer 216 includes an annular spacer 218 extending beyond the level of the exterior bearing surface 140 of the socket 124, extending toward the valve bearing surface 142. The spacer 218 is for setting the desired spacing between the exterior bearing surface 140 of the socket 124 and the valve bearing surface 140, to thereby pre-set the valve lash distance. The thickness of the spacer 218 should correspond with the desired valve lash distance. Thus, for a diesel engine, the spacer 218 may have a thickness of 0.012 inch for an intake valve, and a thickness of 0.018 inch for an exhaust valve. For a lawnmower engine, the spacer 218 may have a thickness of 0.020 inch. Different retainers could be color-coded to correspond with their intended end use. It should be understood that these dimensions are provided by way of example only, and that the present invention is not limited to any particular valve lash distance or spacer thickness unless expressly set forth in the claims. Generally, the spacer 218 should extend to a level spaced from the level of the exterior bearing surface 140 by a distance substantially equal to the desired valve lash distance. It should also be understood that a plurality of discrete spacers could be used instead of an annular spacer.

If a spacer 218 is used on the resilient retainer 216, provision should be made to remove the spacer from the area of the interface 183 between the bearing surfaces 140, 142 after the valve lash distance has been set. In the embodiment of FIG. 15, the socket has a second annular recess 220 spaced above the undercut 182 in the socket 124, farther away from the interface 183.

Figure 16:
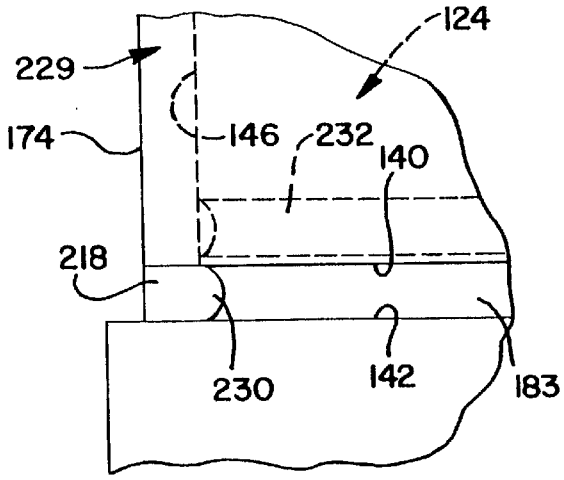
FIG. 16 is an enlarged elevation of a part of one end of another embodiment of a rocker assembly of the present invention showing another embodiment of a resilient retainer with a spacer for pre-setting valve lash distance.

In the embodiment of FIG. 15, the spacer 218 comprises an integral step on the resilient retainer. An alternative embodiment is illustrated in FIG. 16. As there shown, the spacer 218 could comprise a detent 230 on the resilient retainer 229 that snaps back and rises under the force of the valve spring , shown at 147 in FIG. 2. Operation of the engine could cause the retainer 170 to pop up. A recess, such as annular recess 232, may be provided in the socket 123 to catch the detent 230 after the retainer 170 has popped up.

The detent 230 and bottom edge of the socket could cooperate to initially secure the resilient retainer 229 on the socket.

Figure 17:
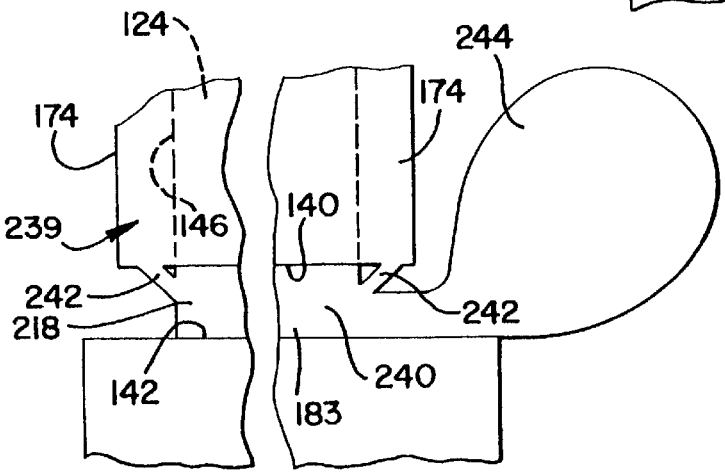
FIG. 17 is an enlarged elevation of a part of one end of another embodiment of a rocker assembly of the present invention showing another embodiment of a resilient retainer with a spacer for pre-setting valve lash distance.

Another alternative embodiment is illustrated in FIG. 17. As there shown, the spacer 218 comprises an elongate sheet 240 having the thickness of the desired valve lash distance. The sheet can be attached to the resilient retainer 239 through break-away connectors 242, for example. The spacer sheet 240 may also be attached to a pull tab 244 that is sized, shaped and has a surface finish that allows a mechanic to grasp the pull tab and pull the entire spacer sheet out from the interface. The spacer sheet 240 will separate from the break-away connectors 244 and may then be discarded.

In both FIGS. 16 and 17, like reference numbers have been used for parts like those of FIGS. 2, 6–10 and 15.

To set the valve lash distance, after the rocker assembly 100 has been assembled with the retainer 216 secured to the socket 124 and the rocker ball 122 held by the retainer 216 in the socket 124, and after the rocker assembly 100 has been mounted on the engine 106, the retainer spacer 218 is placed against the valve bearing surface 142. The rocker assembly includes a set mechanism 222, shown in FIGS. 1–2, as in the prior art. The set mechanism 222 comprises a nut and a threaded screw at the first end 16, 107 of the rocker arm 12, 102. To set the valve lash distance, the set mechanism 222 is adjusted by turning the screw to fix the distance between the exterior bearing surface 140 of the socket 124 and the valve bearing surface 142, and then locking the screw in place with the nut. After the set mechanism 222 has been adjusted to fix the valve lash distance, the spacer 218 is moved out of contact with the valve bearing surface 142. In the embodiment of FIG. 15, the entire resilient retainer 216 is moved along the central longitudinal axis 158 of the socket away from the valve bearing surface 142 until the annular bottom 176 of the resilient retainer is received in the second recess 220 of the socket 124; for the embodiment of FIG. 15 or the embodiment of FIG. 16, the spacer 218 need not travel far enough to be locked into a socket or recess; the spacer 218 in these embodiments should travel far enough to maintain a permanent position spaced away from the interface 183 of the bearing surfaces 140, 142.

Preferably, for all of the illustrated embodiments, the resilient retainer 170, 208, 210, 216, 229, 239 includes a polymeric material. The entire resilient retainer 170, 208, 210, 216, 229, 239 may comprise a polymeric material, or additives may be included, for example, to make the resilient retainer 170, 208, 210, 216, 229, 239, more suitable or more durable for use in the intended environment of an engine. The material should be one that withstands temperatures in the range of about −50° F. to 300° F. The resilient retainer could also comprise a composite material, such as one of these resins combined with fibers, such as glass fibers or other fibers known in the art of making composite articles. The polymeric material may comprise a thermoset resin, a thermoplastic resin, or an epoxy resin, for example. Commercially available materials may be used. Standard additives may be used for any of these materials to achieve desired properties in the final product. The retainers can be formed in any suitable manner, such as by molding. Any necessary machining or finishing of a polymeric retainer should be substantially less expensive than machining or finishing a metallic component such as the socket of the prior art. For the selection of an appropriate material and method of forming the retainer, it is expected that one in the business of making plastic components would be consulted. It should be understood that the resilient retainer could also be made of other materials such as metal, particularly for the embodiment illustrated in FIG. 20. It should also be understood that any materials identified above are identified for purposes of illustration only, and that the invention is not limited to any particular resin unless expressly set forth in the claims.

The rocker assemblies of the present invention may be assembled by securing the retainer 170, 208, 210, 216, 229, 239 to the socket 124 with at least the part of the retainer 170, 208, 210, 216, 229, 239 defining the opening 178 for the rocker ball 122 being outside of the socket. The rocker ball 122 is then inserted through the opening 178 outside of the socket 124 and into the socket itself, until the diameter 163 of the rocker ball 122 is past the opening 178 in the resilient retainer. The part of the resilient retainer defining the opening 178, will be deformed by the rocker ball and then will return to the original dimension after the diameter of the rocker ball has passed through the opening 178. The elements that deform to retain the rocker ball within the socket may be within or outside of the socket. Assembly can be done manually or is preferably automated. Since the resilient retainer essentially need only function to retain the socket on the rocker ball until the rocker assembly is mounted on the engine, the retainer can be designed so that a relatively small force will deform the portion defining the opening 178. Slits may be provided to enable easier deformation of the portion of the socket defining the opening. Retention under forces of 5–15 lbs. should be sufficient.

Operation of the rocker assembly of the present invention will be described with respect to the first illustrated embodiment, but it should be understood that the operation of the other illustrated embodiments would be the same, except where noted. Typically, in an initial at rest position, as shown in FIG. 6, as in the prior art illustrated in FIG. 3, the rocker ball 122 may be canted slightly to one direction, with the central axis 133 of the rocker ball defining an angle Φ with the central axis 158 of the socket. The central axis 158 of the socket is parallel to and slightly offset from the central axis 145 of the valve stem 144. As the cam 116 pushes up on the push rod 112, the first end 107 of the rocker arm 102 is raised, pivoting the rocker arm 107 about its axis 126. As the rocker arm 102 pivots, the second end 120 of the rocker arm is pushed downward, moving the rocker ball 122 through a curved path. As the rocker ball 122 is thus moved, it pivots in the socket 124. As the rocker arm 102 is pivoted about the axis 126, the rocker ball 122 and socket 124 pass through an interim position, shown in FIG. 7, wherein the central axis 158 of the socket and the central axis 133 of the rocker ball 122 are co-linear. At the interim position, the socket bearing surface 140 has slid across the valve bearing surface 142, as shown. The axes 158, 133 remain parallel with the central axis 145 of the valve stem 144. As the cam 116 pushes the rod 112 further upward, the first end 107 of the rocker arm 102 is raised higher, and the second end 120 of the rocker arm 102 is pushed further downward, causing further pivoting of the rocker ball 122, and further linear and sliding movement of the socket 124 on the valve stem 144, and further linear movement of the valve stem 144. These changes in position of the rocker ball and socket are shown in FIG. 8, wherein the central axis 133 of the rocker ball 122 is pivoted to define an angle θ with the central axis 158 of the socket 124. The curved outer surface 128 of the rocker ball 122 bears against the bearing surface 154 of the interior surface 148 of the socket 124, pushing the socket 124 downward, and thus pushing the exterior bearing surface 140 of the socket against the complementary bearing surface 142 of the valve stem 144. As shown in FIG. 8, the central axis 158 of the socket 124 remains parallel with the central axis 145 of the valve stem 144, and the socket slides further along the valve surface 142. Thus, the pivoting motion of the rocker arm 107 is translated to linear and sliding movement of the socket 124 and linear movement of the valve stem 144. Lubrication of the interface 183 limits wear of the contacting bearing surfaces 140, 142. As the valve stem 144 is pushed downward, the valve 149 unseats from its seat on the engine cylinder head 151. The camshaft 118 is driven by the crankshaft (not shown) which is driven by the pistons 153. Fuel may be admitted to the cylinder 151 through a fuel inlet 155.

When the camshaft 118 and cam 116 rotate further to decrease the upward force on the first end 107 of the rocker arm 102, the force of the spring 147 pivots the rocker arm 102 about the axis 126; the rocker ball 122, socket 124, valve stem 144, and resilient retainer 170 return to the position shown in FIG. 6, and the valve 149 is reseated in the cylinder head 151.

The resilient retainer 170 should be shaped so that the rocker ball 122 may pivot through its full desired range of motion without interference from the resilient retainer 170. The shape and dimensions of the rocker ball 122 may also be designed to maximize the range of motion, such as by adjusting the dimensions of the neck 134 portion of the rocker ball 122.

It should be understood that although slight gaps may be shown in the accompanying drawings at the interfaces of the socket and valve bearing surfaces 140, 142 and at the interfaces of the rocker ball and socket surfaces 128, 154, these surfaces would be expected to bear substantially against each other under force, with a film of lubricant as is standard for the interfaces of such bearing parts.

It should also be understood that in the drawings some distances or dimensions ay be somewhat exaggerated for purposes of illustration. For example, the gaps 74 and 183 are typically on the order of 0.012 to 0.20 inches.

If the resilient retainer has holes 185, 187, 189 and channels 184 for lubricant as in the first embodiment, the interface 183 between the bearing surfaces 140, 142 may be kept adequately lubricated. Other features of the present invention may be used with sockets and rocker balls having channels for lubricant as in the prior art.

As discussed above, the socket 124 of the present invention may be made in a conventional manner, or if the socket of the first illustrated embodiment is used, it may be formed by cold heading or through a powder metal forming or pressing process. It should be understood that cold heading as used herein is intended to encompass any cold forming of a metal slug, such as extrusion.

It should be understood that the various features of the present invention may be used in combination, or that individual features may be used, or that individual features may be combined. The invention is not intended to be limited to any particular feature unless expressly set forth in the claims.

It should also be understood that the features of the present invention may be used with both diesel and gasoline engines.

While only specific embodiments of the invention have been described and shown, it is apparent that various alternatives and modifications can be made thereto, and that parts of the invention may be used without using the entire invention. Those skilled in the art will recognize that certain modifications can be made in these illustrative embodiments. It is the intention in the appended claims to cover all such modifications and alternatives as may fall within the true scope of the invention.

We claim:

1. In a rocker assembly for opening a valve in an engine, the rocker assembly having a rocker arm with a first end to be driven by a push rod and a second end, the rocker assembly further including a rocker ball secured to the second end of the rocker arm and a socket on the rocker ball, the rocker arm being pivotable about an axis between the first and second ends so that as the first end is pushed by the push rod the rocker arm pivots about the axis to move the second end to open the valve, the rocker ball having a curved outer surface with a center of curvature and a bottom, the center of curvature being between the bottom of the rocker ball and the second end of the rocker arm, the socket having an exterior bearing surface to act against a valve bearing surface for opening the valve, an exterior non-bearing surface, an interior surface and a top with a central opening to receive the rocker ball, the interior surface of the socket including an interior bearing surface for contacting a portion of the rocker ball curved outer surface so that pivoting motion of the rocker arm can be translated to linear movement of the socket against the valve bearing surface, the rocker assembly further including a retainer for securing the socket on the rocker ball, the improvement wherein the retainer extends to the level of the exterior bearing surface of the socket and includes a channel for the delivery of lubricant to the exterior bearing surface of the socket.

2. In a rocker assembly for opening a valve in an engine, the rocker assembly having a rocker arm with a first end and a second end, the rocker assembly further including a rocker ball secured to the second end of the rocker arm, a socket and a retainer, the rocker arm being pivotable about an axis between the first and second ends to move the rocker ball relative to the socket, the rocker ball having a curved outer surface with a center of curvature and a bottom, the center of curvature being between the bottom of the rocker ball and the second end of the rocker arm, the socket having an exterior bearing surface to act against a valve bearing surface for opening the valve, an exterior non-bearing surface, an interior surface and a top with a central opening to receive the rocker ball, the interior surface of the socket including an interior bearing surface for contacting a portion of the rocker ball curved outer surface, the socket having a height from the level of the exterior bearing surface to the level of the top of the socket, the improvement wherein:

the retainer comprises a resilient element secured to the socket and extending from the level of the exterior bearing surface of the socket toward the top of the socket and being shaped and sized to keep the socket and the rocker ball together and to allow relative motion between the rocker ball and the socket as the rocker arm pivots.

3. A rocker assembly for opening a valve in an engine, the rocker assembly having a rocker arm with a first end and a second end, a rocker ball secured to the second end of the rocker arm, a socket and a retainer, the rocker arm being pivotable about an axis between the first and second ends, the rocker ball having a curved outer surface with a center of curvature and a bottom, the center of curvature being between the bottom of the rocker ball and the second end of the rocker arm, the socket having a central longitudinal axis, an exterior bearing surface to act against a valve bearing surface for opening the valve, an exterior non-bearing surface, an interior surface and a top with a central opening to receive the rocker ball, the interior surface of the socket including an interior bearing surface for contacting a portion of the rocker ball curved outer surface, the socket having a height from the top to the exterior bearing surface, the exterior non-bearing surface of the socket extending upward from the exterior bearing surface to the top and having a uniform outer diameter from the top to the exterior bearing surface, the retainer comprising a resilient material and having a side with a height, the side having an interior surface and a uniform inner diameter through the height of the side, the interior surface of the retainer being positioned against the exterior non-bearing surface of the socket along at least part of the height of the socket and at least part of the height of the side of the retainer.

4. In a rocker assembly for opening a valve in an engine, the rocker assembly having a rocker arm with a first end and a second end, the rocker assembly further including a rocker ball secured to the second end of the rocker arm, a socket and a retainer, the rocker arm being pivotable about an axis between the first and second ends to move the second end to open the valve, the rocker ball having a curved outer surface with a center of curvature and a bottom, the center of curvature being between the bottom of the rocker ball and the second end of the rocker arm, the socket having an exterior bearing surface to act against a valve bearing surface for opening the valve, an exterior non-bearing surface, an interior surface and a top with a central opening to receive the rocker ball, the interior surface of the socket including an interior bearing surface for contacting a portion of the rocker ball curved outer surface, a method of assembling the rocker components including securing the retainer to the socket with at least part of the retainer being outside of the socket, inserting the rocker ball through the retainer while the part of the retainer is outside of the socket and pushing said rocker ball through the part of the retainer outside of the socket until the center of curvature of the rocker ball has passed the part of the retainer outside of the socket, wherein after assembly said socket and said retainer can pivot relative to the rocker ball without distorting the retainer.

5. In a rocker assembly for opening a valve in an engine, the rocker assembly having a rocker arm with a first end and a second end, the rocker assembly further including a rocker ball secured to the second end of the rocker arm, a socket and a retainer, the rocker arm being pivotable about an axis between the first and second ends to move the second end to open the valve, the rocker ball having a central longitudinal axis, a curved outer surface with a center of curvature and a bottom, the center of curvature being between the bottom of the rocker ball and the second end of the rocker arm, the socket having a central longitudinal axis, an exterior bearing surface to act against a valve bearing surface for opening the valve, an exterior non-bearing surface, an interior surface and a top with a central opening to receive the rocker ball, the interior surface of the socket including an interior bearing surface for contacting a portion of the rocker ball curved outer surface, the exterior non-bearing surface having an outer diameter, the rocker ball and socket having a range of relative motion wherein the central longitudinal axis of the socket is co-linear with the central longitudinal axis of the rocker ball at one point in the range of relative motion and wherein the central longitudinal axis of the rocker ball intersects the central longitudinal axis of the socket at an angle at another point in the range of relative motion, the improvement wherein the retainer comprises a polymeric material selected from the group consisting of thermoset resins, thermoplastic resins and epoxy resins and wherein the retainer has a top having a central opening, the central opening of the top of the retainer having an inner diameter less than the twice the radius of curvature of the rocker ball and less than the smallest outer diameter of the socket, the top of the retainer being between the rocker arm and a plane through the center of curvature of the rocker ball and perpendicular to the central longitudinal axis of the rocker ball when the central longitudinal axis of the rocker ball is co-linear with the central longitudinal axis of the socket, the retainer being spaced from the rocker arm during at least part of said range of relative motion.

6. A method of setting valve lash distance comprising:

providing a rocker assembly for opening a valve in an engine, the rocker assembly having a rocker arm with a first end to be driven by a push rod and a second end, the rocker assembly further including a rocker ball secured to the second end of the rocker arm, a socket on the rocker ball and a valve lash set mechanism, the rocker arm being pivotable about an axis between the first and second ends so that as the first end is pushed by the push rod the rocker arm pivots about the axis to move the second end to open the valve, the rocker ball having a curved outer surface with a center of curvature and a bottom, the center of curvature being between the bottom of the rocker ball and the second end of the rocker arm, the socket having an exterior bearing surface to act against a valve bearing surface for pushing the valve, an exterior non-bearing surface, an interior surface and a top with a central opening to receive the rocker ball, the interior surface of the socket including an interior bearing surface for contacting a portion of the rocker ball curved outer surface so that pivoting motion of the rocker arm can be translated to linear movement of the socket against the valve bearing surface, the rocker assembly further including a retainer for securing the socket on the rocker ball, wherein the retainer includes a spacer beyond the level of the exterior bearing surface of the socket for setting a desired spacing between the exterior bearing surface of the socket and the valve bearing surface for setting the valve lash distance;

the method further comprising the acts of:

placing the retainer spacer against the valve bearing surface, adjusting the set mechanism to fix the distance between the exterior bearing surface of the socket and the valve bearing surface; and moving the retainer spacer out of contact with the valve bearing surface after the distance is fixed;

wherein the socket has a central longitudinal axis perpendicular to the exterior bearing surface of the socket and the act of moving the retainer spacer comprises moving the retainer along the central longitudinal axis of the socket away from the valve bearing surface.

7. In a rocker assembly for opening a valve in an engine, the rocker assembly having a rocker arm with a first end and a second end, the rocker assembly further including a rocker ball secured to the second end of the rocker arm and a socket on the rocker ball, the rocker arm being pivotable about an axis between the first and second ends to move the second end to open the valve, the rocker ball having a curved outer surface with a center of curvature and a bottom, the center of curvature being between the bottom of the rocker ball and the second end of the rocker arm, the socket having an exterior bearing surface to act against a valve bearing surface for pushing the valve, an exterior non-bearing surface, an interior surface and a top with a central opening to receive the rocker ball, the interior surface of the socket including an interior bearing surface for contacting a portion of the rocker ball curved outer surface so that pivoting motion of the rocker arm can be translated to linear movement of the socket against the valve bearing surface, the rocker assembly further including a retainer for securing the socket on the rocker ball, the improvement wherein the retainer includes a spacer beyond the level of the exterior bearing surface of the socket for setting a desired spacing between the exterior bearing surface of the socket and the valve bearing surface for setting the valve lash distance, at least a part of the retainer being connected to said spacer.

8. The improved rocker assembly of claim 7 further comprising a valve lash set mechanism associated with said rocker arm assembly, the rocker arm assembly being used in a method of setting the valve lash distance, the method comprising:

placing the retainer spacer against the valve bearing surface, adjusting the set mechanism to fix the distance between the exterior bearing surface of the socket and the valve bearing surface, and moving the retainer spacer out of contact with the valve bearing surface after the distance is fixed.

9. In a rocker assembly for opening a valve in an engine, the rocker assembly having a rocker arm with a first end and a second end, the rocker assembly further including a rocker ball secured to the second end of the rocker arm, a socket and a retainer, the rocker arm being pivotable about an axis between the first and second ends to move the second end to open the valve, the rocker ball having a central longitudinal axis and a curved outer surface with a center of curvature and a bottom, the center of curvature being between the bottom of the rocker ball and the second end of the rocker arm, the socket having a central longitudinal axis, an exterior bearing surface to act against a valve bearing surface for opening the valve, an exterior non-bearing surface, an interior surface and a top with a central opening to receive the rocker ball, the interior surface of the socket including an interior bearing surface for contacting a portion of the rocker ball curved outer surface, the improvement wherein:

the retainer comprises a resilient element secured to the socket and extending beyond the socket to a position between the top of the socket and the rocker arm, the center of curvature of the rocker ball being between the bottom of the rocker ball and a plane through at least part of the resilient retainer, the rocker ball and socket being capable of relative movement and having a range of relative motion, there being a bottom ball plane through the bottom of the rocker ball and perpendicular to the central longitudinal axis of the rocker ball, wherein contact between the retainer and any other element above said bottom ball plane is limited to contact between the retainer and the socket during at least one part of said range of relative motion.

10. The improved rocker assembly of claim 9 wherein the retainer includes a projection and at least one of the surfaces of the socket includes a depression to receive the retainer projection to secure the retainer on the socket.

11. The improved rocker assembly of claim 1 wherein the retainer is secured to one of the exterior surfaces of the socket.

12. The improved rocker assembly of claim 9 wherein the retainer includes a spacer beyond the level of the exterior bearing surface of the socket for setting a desired space between the exterior bearing surface of the socket and the valve bearing surface for setting the valve lash distance.

13. The improved rocker assembly of claim 9 wherein the rocker assembly is assembled by securing the resilient retainer to the socket with at least the part of the resilient retainer defining the opening outside of the socket and inserting the rocker ball through the retainer opening outside of the socket.

14. The improved rocker assembly of claim 9 wherein the retainer has a top with an opening at least a portion of which has a cross-dimension less than the diameter of the curved outer surface of the rocker ball.

15. The improved rocker assembly of claim 14 wherein the rocker ball has a neck between the curved outer surface and the rocker arm, the neck extending through the opening in the top of the retainer.

16. The improved rocker assembly of claim 9 wherein the bearing surface of the interior surface of the socket comprises a segment of the interior surface of the socket and wherein the top of the socket is at the level of the top of the segment defining the bearing surface of the interior surface of the socket.

17. The improved rocker assembly of claim 16 wherein the cross-dimension of the opening in the socket interior surface at the top of the socket is less than the diameter of the rocker ball at the center of curvature.

18. The improved rocker assembly of claim 9 wherein the retainer includes at least a portion exterior to the socket at the level of the exterior bearing surface of the socket, the retainer further including channels for delivering lubricant to the area of the exterior bearing surface of the socket.

19. The improved rocker assembly of claim 18 wherein the socket comprises a metal component selected from the group consisting of elements wherein the interior surface is formed in a cold heading operation and elements made of powder metal wherein the interior surface is formed in a pressing operation.

20. The improved rocker assembly of claim 18 wherein the retainer includes a polymeric material selected from the group consisting of thermoset resins, thermoplastic resins and epoxy resins.

21. The improved rocker assembly of claim 18 wherein the retainer includes a spacer beyond the level of the exterior bearing surface of the socket for setting a desired spaced between the exterior bearing surface of the socket and the valve bearing surface for setting the valve lash distance.

22. The improved rocker assembly of claim 9 wherein the socket comprises a metal component selected from the group consisting of elements wherein the interior surface is formed in a cold heading operation and elements made of powder metal wherein the interior surface is formed in a pressing operation.

23. The improved rocker assembly of claim 22 wherein the retainer includes a polymeric material selected from the group consisting of thermoset resins, thermoplastic resins and epoxy resins.

24. The improved rocker assembly of claim 22 wherein the retainer includes a spacer beyond the level of the exterior bearing surface of the socket for setting a desired spaced between the exterior bearing surface of the socket and the valve bearing surface for setting the valve lash distance.

25. The improved rocker assembly of claim 9 wherein the retainer includes a polymeric material selected from the group consisting of thermoset resins, thermoplastic resins and epoxy resins.

26. The improved rocker assembly of claim 25 wherein the retainer includes a spacer beyond the level of the exterior bearing surface of the socket for setting a desired spaced between the exterior bearing surface of the socket and the valve bearing surface for setting the valve lash distance.

27. The improved rocker assembly of claim 26 wherein:

the retainer includes at least a portion exterior to the socket at the level of the exterior bearing surface of the socket, the retainer further including channels for delivering lubricant to the area of the exterior bearing surface of the socket; and the socket comprises a metal component selected from the group consisting of elements wherein the depression is formed in a cold heading operation and elements made of powder metal wherein the depression is formed in a pressing operation.

* * * * *